US011145258B2

(12) United States Patent
Tang

(10) Patent No.: US 11,145,258 B2
(45) Date of Patent: Oct. 12, 2021

(54) METHOD FOR ADJUSTING BRIGHTNESS OF DISPLAY DEVICE AND DISPLAY DEVICE

(71) Applicant: TCL CHINA STAR OPTOELECTRONICS TECHNOLOGY CO., LTD., Guangdong (CN)

(72) Inventor: Shijiong Tang, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 16/766,764

(22) PCT Filed: Apr. 3, 2020

(86) PCT No.: PCT/CN2020/083096

§ 371 (c)(1),
(2) Date: May 26, 2020

(65) Prior Publication Data

US 2021/0280143 A1 Sep. 9, 2021

(51) Int. Cl.
*G09G 3/34* (2006.01)
*G09G 3/32* (2016.01)

(52) U.S. Cl.
CPC ..... *G09G 3/3406* (2013.01); *G09G 3/32* (2013.01); *G09G 2300/0465* (2013.01); *G09G 2320/0626* (2013.01); *G09G 2330/028* (2013.01)

(58) Field of Classification Search
None
See application file for complete search history.

(56) References Cited

U.S. PATENT DOCUMENTS

2009/0096711 A1* 4/2009 Jang ..... G06F 3/1446 345/1.3
2011/0292018 A1* 12/2011 Kubota ..... G09G 3/3426 345/211
2014/0192091 A1* 7/2014 Fan ..... G09G 3/3607 345/690
2015/0130867 A1* 5/2015 Park ..... G09G 3/2092 345/694
2017/0263198 A1* 9/2017 Zhu ..... G09G 3/3607
2018/0068637 A1* 3/2018 Ninan ..... G09G 5/10

* cited by examiner

*Primary Examiner* — Chad M Dicke
(74) *Attorney, Agent, or Firm* — Mark M. Friedman

(57) ABSTRACT

Embodiments of the present disclosure provide a device and a method for adjusting brightness of a display device. In the method for adjusting brightness of the display device, a first voltage data is applied to the display device when a peak brightness condition is met, or a second voltage data is applied to the display device when the peak brightness condition is not met, enabling the first voltage data greater than the second voltage data to be applied to the display device when the peak brightness condition is met, thus increasing the brightness when the display device emits light to display an image to be displayed and improving contrast.

16 Claims, 2 Drawing Sheets

METHOD FOR ADJUSTING BRIGHTNESS OF DISPLAY DEVICE AND DISPLAY DEVICE

TECHNICAL FIELD

The present disclosure relates to the field of display technology, and in particular, to a device and a method for adjusting brightness of a display device.

BACKGROUND

In current miniature light-emitting diode (mini LED) screens, mini LEDs are disposed on an array substrate, and are driven by thin film transistors (TFTs) of the array substrate to emit light. In brightness adjustments of mini LEDs, sub-field control technology is used to adjust brightness in different grayscales. However, in current brightness adjustment processes, brightness of the screens cannot reach a peak due to brightness adjustments carried out in a linear manner, resulting in poor contrast of the screens.

Therefore, there is a technical problem that the brightness of the current mini LED screen cannot reach the peak, resulting in the poor contrast of the screen.

SUMMARY

Embodiments of the present disclosure provide a device and a method for adjusting brightness of a display device, to solve the technical problem that the brightness of the current mini LED screen cannot reach the peak, resulting in the poor contrast of the screen.

In order to solve the above problem, the embodiments of the present disclosure provide following technical solutions.

The embodiment of the present disclosure provides a method for adjusting brightness of a display device, and the method for adjusting brightness of the display device comprises obtaining brightness information of an image to be displayed by a display device, determining whether a peak brightness condition is met according to the brightness information of the image to be displayed by the display device, and applying first voltage data to the display device when the peak brightness condition is met, or applying second voltage data to the display device when the peak brightness condition is not met, wherein the first voltage data is greater than the second voltage data.

In a method for adjusting brightness of a display device provided in an embodiment of the present disclosure, obtaining the brightness information of the image to be displayed by the display device comprises obtaining a first light-emitting area of the display device, obtaining a second light-emitting area of the image to be displayed by the display device, and obtaining the brightness information of the image to be displayed by the display device according to the first light-emitting area and the second light-emitting area.

In a method for adjusting brightness of a display device provided in an embodiment of the present disclosure, obtaining the first light-emitting area of the display device comprises obtaining an area of a display area of the display device, obtaining an area of a non-light-emitting region of the display area of the display device, and obtaining the first light-emitting area by subtracting the area of the non-light-emitting region of the display area from the area of the display area.

In a method for adjusting brightness of a display device provided in an embodiment of the present disclosure, obtaining the second light-emitting area of the image to be displayed by the display device comprises determining a number of pixels in the image to be displayed, obtaining an area of a single one of the pixels, and determining the second light-emitting area according to the number of the pixels in the image to be displayed and the area of the single one of the pixels.

In a method for adjusting brightness of a display device provided in an embodiment of the present disclosure, obtaining the brightness information of the image to be displayed by the display device according to the first light-emitting area and the second light-emitting area comprises obtaining first data by dividing the second light-emitting area by the first light-emitting area, and using the first data as the brightness information of the image to be displayed by the display device.

In a method for adjusting brightness of a display device provided in an embodiment of the present disclosure, determining whether the peak brightness condition is met according to the brightness information of the image to be displayed by the display device comprises obtaining the first data as the brightness information of the image to be displayed by the display device, setting second data as a judging condition of a brightness stage of the display device, comparing the first data with the second data, and determining whether the peak brightness condition is met according to a comparison between the first data and the second data.

In a method for adjusting brightness of a display device provided in an embodiment of the present disclosure, the method that applying the first voltage data to the display device when the peak brightness condition is met, or applying the second voltage data to the display device when the peak brightness condition is not met, wherein the first voltage data is greater than the second voltage data, comprises setting the second voltage data, and setting the first voltage data according to the second voltage data and preset data.

In a method for adjusting brightness of a display device provided in an embodiment of the present disclosure, setting the first voltage data according to the second voltage data and the preset data comprises obtaining the second voltage data, setting the preset data according to the first data, and setting the first voltage data according to the second voltage data and the preset data.

In a method for adjusting brightness of a display device provided in an embodiment of the present disclosure, obtaining the brightness information of the image to be displayed by the display device comprises obtaining a third light-emitting area of a first area of the display device, obtaining a fourth light-emitting area of the image to be displayed by the display device, and obtaining the brightness information of the image to be displayed by the display device according to the third light-emitting area and the fourth light-emitting area.

In a method for adjusting brightness of a display device provided in an embodiment of the present disclosure, obtaining the third light-emitting area of the first area the display device comprises obtaining a display area of the first area of the display device, obtaining an area of a non-light-emitting region of the first area of the display device, and obtaining the third light-emitting area by subtracting the area of the non-light-emitting region of the first area from the display area of the first area.

Meanwhile, an embodiment of the present disclosure provides a brightness adjusting device for a display device, and the brightness adjusting device for a display device comprises a brightness information obtaining module configured to obtain brightness information of an image to be displayed by a display device, a determining module configured to determine whether a peak brightness condition is met according to the brightness information of the image to be displayed by the display device, and a data input module configured to apply a first voltage data to the display device when the peak brightness condition is met, or apply a second voltage data to the display device when the peak brightness condition is not met, wherein the first voltage data is greater than the second voltage data.

In a brightness adjusting device for a display device provided in an embodiment of the present disclosure, the brightness information obtaining module comprises a first brightness information obtaining module configured to obtain a first light-emitting area of the display device, a second brightness information obtaining module configured to obtain a second light-emitting area of the image to be displayed by the display device, and a first brightness information processing module configured to obtain the brightness information of the image to be displayed by the display device according to the first light-emitting area and the second light-emitting area.

In a brightness adjusting device for a display device provided in an embodiment of the present disclosure, the first brightness information obtaining module comprises a first area obtaining module configured to obtain an area of a display area of the display device, a second area obtaining module configured to obtain an area of a non-light-emitting region of the display area of the display device, and an area processing module configured to obtain the first light-emitting area by subtracting the area of the non-light-emitting region of the display area from the area of the display area.

In a brightness adjusting device for a display device provided in an embodiment of the present disclosure, the second area obtaining module comprises a pixel information obtaining module configured to determine a number of pixels in the image to be displayed, a pixel area module configured to obtain an area of a single one of the pixels, and a pixel area processing module configured to determine the second light-emitting area according to the number of the pixels in the image to be displayed and the area of the single one of the pixels.

In a brightness adjusting device for a display device provided in an embodiment of the present disclosure, the first brightness information processing module comprises a first processing module configured to obtain first data by dividing the second light-emitting area by the first light-emitting area, and a second processing module configured to use the first data as the brightness information of the image to be displayed by the display device.

In a brightness adjusting device for a display device provided in an embodiment of the present disclosure, the determining module comprises a first data obtaining module configured to obtain the first data as the brightness information of the image to be displayed by the display device, a setting module configured to set a second data as a judging condition of a brightness stage of the display device, a comparing module configured to compare the first data with the second data, and a comparison processing module configured to determine whether the peak brightness condition is met according to a comparison between the first data and the second data.

In a brightness adjusting device for a display device provided in an embodiment of the present disclosure, the data input module comprises a second voltage data setting module configured to set the second voltage data, and a first voltage data setting module configured to set the first voltage data according to the second voltage data and preset data.

In a brightness adjusting device for a display device provided in an embodiment of the present disclosure, the first voltage data setting module comprises a second voltage data obtaining module configured to obtain the second voltage data, a preset data setting module configured to set the preset data according to the first data, and a first voltage data determining module configured to set the first voltage data according to the second voltage data and the preset data.

In a brightness adjusting device for a display device provided in an embodiment of the present disclosure, the brightness information obtaining module comprises a third brightness information obtaining module configured to obtain a third light-emitting area of a first area of the display device, a fourth brightness information obtaining module configured to obtain a fourth light-emitting area of the image to be displayed by the display device, and a second brightness information processing module configured to obtain the brightness information of the image to be displayed by the display device according to the third light-emitting area and the fourth light-emitting area.

In a brightness adjusting device for a display device provided in an embodiment of the present disclosure, the third brightness information obtaining module comprises a display area of the first area obtaining module configured to obtain a display area of the first area of the display device, a non-light-emitting region of the first area obtaining module configured to obtain an area of a non-display region of the first area of the display device, and a first area processing module configured to obtain the third light-emitting area by subtracting the area of the non-light-emitting region of the first area from the display area of the first area.

The embodiments of the present disclosure provide a device and a method for adjusting brightness of a display device. The method for adjusting brightness of the display device comprises obtaining brightness information of an image to be displayed by a display device, determining whether a peak brightness condition is met according to the brightness information of the image to be displayed by the display device, and applying first voltage data to the display device when the peak brightness condition is met, or applying second voltage data to the display device when the peak brightness condition is not met, wherein the first voltage data is greater than the second voltage data. Before applying the display voltage data to the display device, whether the peak brightness condition is met is determined first, wherein the first voltage data is applied to the display device when the peak brightness condition is met, or the second voltage data is applied to the display device when the peak brightness condition is not met, enabling the first voltage data greater than the second voltage data to be applied to the display device when the peak brightness condition is met, increasing the brightness when the display device emits light to display the image to be displayed and even increasing the brightness to the peak brightness, improving the contrast, and solving the technical problem that the brightness of the current mini LED screen cannot reach the peak to result in the poor contrast of the screen.

DETAILED DESCRIPTION OF PREFERRED EMBODIMENTS

The embodiments of the present disclosure provide a device and a method for adjusting brightness of a display device. Purposes and technical solutions of the present disclosure and the advantages thereof will be further described in detail in the following with reference to exemplary embodiments and the corresponding accompanying drawings. It should be understood that the described exemplary embodiments are only used to interpret the present disclosure, and not to limit the present disclosure.

The present disclosure aims at the technical problem that the brightness of the current mini LED screen cannot reach the peak, resulting in the poor contrast of the screen, and is configured to solve the technical problem.

Figure 1:
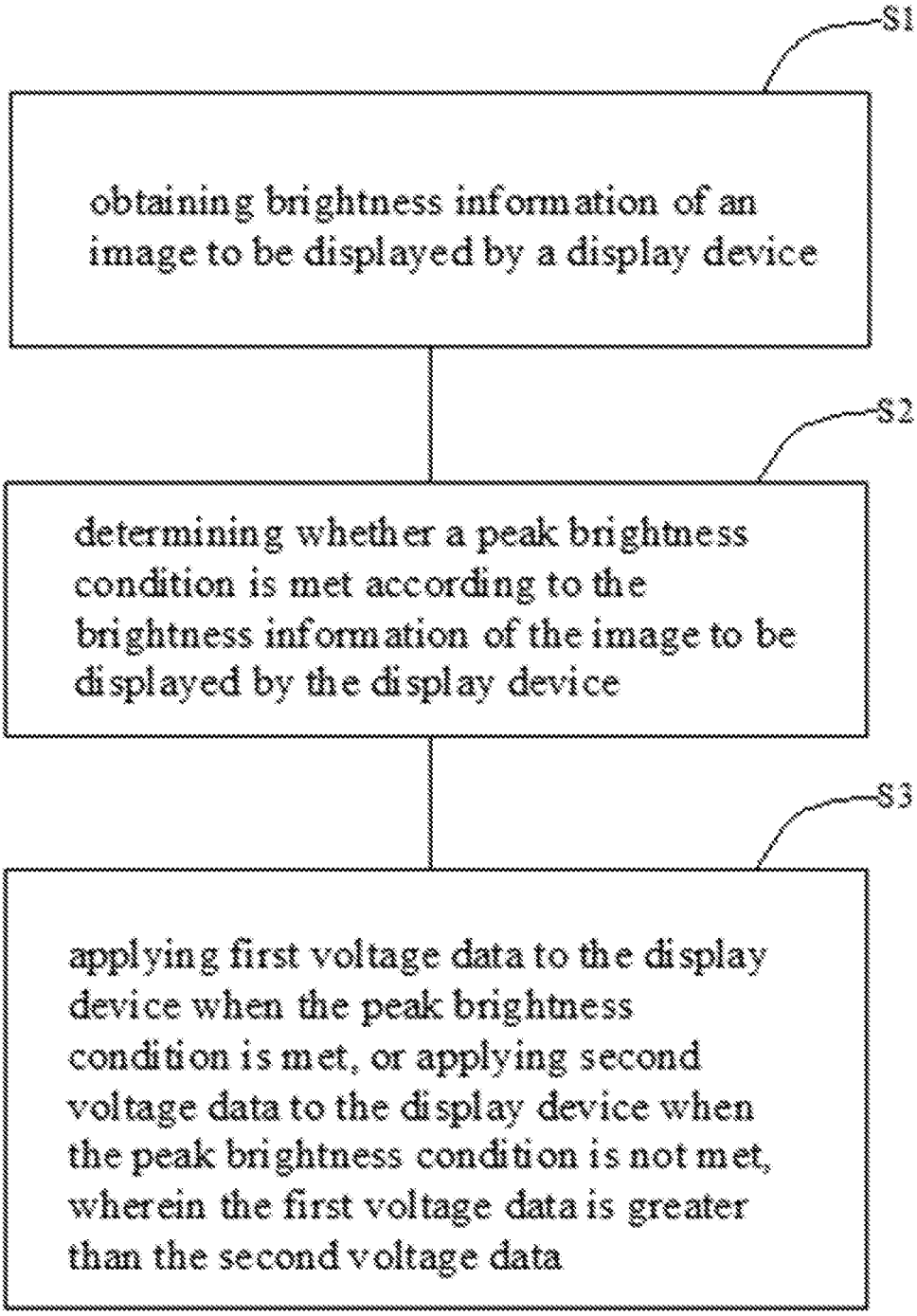
FIG. 1 is a flow diagram illustrating a method for adjusting brightness of a display device according to an embodiment of the present disclosure.

As shown in FIG. 1, an embodiment of the present disclosure provides a method for adjusting brightness of a display device. The method for adjusting brightness of the display device comprises:

S1, obtaining brightness information of an image to be displayed by a display device;

S2, determining whether a peak brightness condition is met according to the brightness information of the image to be displayed by the display device; and S3, applying first voltage data to the display device when the peak brightness condition is met, or applying second voltage data to the display device when the peak brightness condition is not met, wherein the first voltage data is greater than the second voltage data.

The embodiment of the present disclosure provides the method for adjusting brightness of the display device. The method for adjusting brightness of the display device comprises obtaining brightness information of an image to be displayed by a display device, determining whether a peak brightness condition is met according to the brightness information of the image to be displayed by the display device, and applying first voltage data to the display device when the peak brightness condition is met, or applying second voltage data to the display device when the peak brightness condition is not met, wherein the first voltage data is greater than the second voltage data. Before applying the display voltage data to the display device, whether the peak brightness condition is met is determined first, wherein the first voltage data is applied to the display device when the peak brightness condition is met, or the second voltage data is applied to the display device when the peak brightness condition is not met, enabling the first voltage data greater than the second voltage data to be applied to the display device when the peak brightness condition is met, increasing brightness when the display device emits light to display the image to be displayed and even increasing the brightness to peak brightness, improving the contrast, and solving the technical problem that the brightness of the current mini LED screen cannot reach the peak to cause the poor contrast of the screen.

It should be interpreted that the brightness information comprises a value of the brightness of the display device, an area of a brightness area of the display device, and a proportion of the brightness area occupied in a total area, and is not limited hereto in the embodiment of the present disclosure. The brightness information is interpreted in the following embodiments, and a stage of the display device can be obtained according to the brightness information of the display device, so as to provide corresponding voltage data, so that the brightness of the display device can reach the peak.

In an embodiment, obtaining the brightness information of the image to be displayed by the display device comprises:

obtaining a first light-emitting area of the display device;

obtaining a second light-emitting area of the image to be displayed by the display device; and obtaining the brightness information of the image to be displayed by the display device according to the first light-emitting area and the second light-emitting area. When to be obtained, the brightness information of the image to be displayed by the display device is determined according to the light-emitting area of the display device and the light-emitting area of the image to be displayed by the display device. That is to say, the brightness information of the image to be displayed by the display device can be determined according to a value of the light-emitting area of the image to be displayed by the display device, or according to a proportion of an area of the light-emitting area of the image to be displayed occupied in an area of a total light-emitting area. The first light-emitting area of the display device and the second light-emitting area of the image to be displayed are obtained, and the brightness information of the display device can be obtained according to a comparison between or a relational analysis of the first light-emitting area and the second light-emitting area.

In an embodiment, obtaining the first light-emitting area of the display device comprises:

obtaining an area of a display area of the display device;

obtaining an area of a non-light-emitting region of the display area of the display device; and obtaining the first light-emitting area by subtracting the area of the non-light-emitting region of the display area from the area of the display area. A region capable of emitting light of the display area is used as the first light-emitting area. An area of a display area of the display device is obtained first, and then an area of a non-light-emitting region of the display area is obtained, thus obtaining an area of the region capable of emitting light of the display area, namely obtaining a total area of a region capable of emitting light.

In an embodiment, obtaining the second light-emitting area of the image to be displayed by the display device comprises:

determining a number of pixels in the image to be displayed;

obtaining an area of a single one of the pixels; and determining the second light-emitting area according to the number of the pixels in the image to be displayed and the area of the single one of the pixels. When the second light-emitting area is to be determined, due to a fixed resolution and a fixed size of the display device, the area of the single pixel of the display device is determined according to parameters of the display device. After the number of the pixels in the image to be displayed is determined, the second light-emitting area is determined according to the number of the pixels in the image to be displayed and the area of the single one of the pixels, that is, whether the display device meets the peak brightness condition is determined according to a relation between a maximum light-emitting area and an actual light-emitting area in the display area, that is, the brightness information is obtained according to a relationship between an area of an actual lightened portion and an area of the maximum light-emitting area in the display device. Therefore, whether the display device needs to be changed to the peak brightness can be determined according to the area of the actual lightened portion of the display device.

In an embodiment, obtaining the brightness information of the image to be displayed by the display device according to the first light-emitting area and the second light-emitting area comprises:

obtaining first data by dividing the second light-emitting area by the first light-emitting area; and using the first data as the brightness information of the image to be displayed by the display device. The first data, namely a ratio of the actual light-emitting area occupied in the maximum light-emitting area, is obtained by dividing the second light-emitting area by the first light-emitting area, namely by the ratio of the actual light-emitting area to the maximum light-emitting area. Thus, whether the display device needs to reach the peak brightness is determined according to the ratio. For example, when the lightened area of the display device is large, that is, when the first data is large, it is not necessary to make the display device reach the peak brightness to get high contrast, however, when the lightened area of the display device is small, that is, when the first data is small, the display device can be configured to reach the peak brightness to improve high contrast of the image in different areas. Of course, the display device can be configured to reach the peak brightness when the lightened area of the display device is large, while it is not necessary to make the display device reach the peak brightness when the lightened area of the display device is small. It is not limited hereto in the embodiment of the present disclosure, but is determined according to the actual needs when the display device is lightened.

In an embodiment, determining whether the peak brightness condition is met according to the brightness information of the image to be displayed by the display device comprises:

obtaining the first data as the brightness information of the image to be displayed by the display device;

setting second data as a judging condition of a brightness stage of the display device;

comparing the first data with the second data; and determining whether the peak brightness condition is met according to a comparison between the first data and the second data. After the first data is obtained, the second data is set as the judging condition to be compared with the first data, such as subtracting the second data from the first data. When the difference between the first data and the second data is greater than a preset value or greater than zero, the peak brightness condition is determined to be satisfied or not satisfied, thus a corresponding voltage data is output to the display device, so as to make the display device be at the peak brightness or not be at the peak brightness.

In an embodiment, the method that applying the first voltage data to the display device when the peak brightness condition is met, or applying the second voltage data to the display device when the peak brightness condition is not met, wherein the first voltage data is greater than the second voltage data, comprises:

setting the second voltage data; and setting the first voltage data according to the second voltage data and preset data. Before the first voltage data and the second voltage data are output, the first voltage data and the second voltage data need to be set. For example, when the second voltage data is to be set, the second voltage data can be increased in comparison with that in the current technology, and the first voltage data is increased in comparison with the second voltage data, and even a value of the first voltage data can drive the display device to reach the peak brightness, thus correspondingly improving the contrast of the display device. The preset data can be determined according to a watching experience of the display device, or according to contrast corresponding to brightness to supplement the second voltage data, increasing the first voltage data, increasing the contrast of the display device, making the brightness of the display device reach the peak, and greatly improving the contrast of the display device.

In an embodiment, setting the first voltage data according to the second voltage data and the preset data comprises:

obtaining the second voltage data;

setting the preset data according to the first data; and setting the first voltage data according to the second voltage data and the preset data.

In an embodiment, obtaining the brightness information of the image to be displayed by the display device comprises:

obtaining a third light-emitting area of a first area of the display device;

obtaining a fourth light-emitting area of the image to be displayed by the display device; and obtaining the brightness information of the image to be displayed by the display device according to the third light-emitting area and the fourth light-emitting area. When the display device is applied with voltage data to adjust brightness, a portion of the display device can be adjusted. For example, a maximum light-emitting area of the portion of the display device can be obtained, namely an area of the portion capable of emitting light. Then the image to be displayed by the display device is obtained and a light-emitting area of the portion is counted, thus obtaining the brightness information of the image to be displayed by the display device according to the light-emitting area of the portion and the maximum light-emitting area such as the brightness information of the image to be displayed in the first area. Whether the brightness information of the portion meets the peak brightness condition is determined, when the brightness information of the portion meets the peak brightness condition correspondingly, the first voltage data is applied to the portion, and when the brightness information of the portion does not meet the peak brightness condition, the second voltage data is applied to the portion, achieving the peak brightness of the portion and improving the contrast of the portion.

In an embodiment, obtaining the third light-emitting area of the first area the display device comprises:

obtaining a display area of the first area of the display device;

obtaining an area of a non-light-emitting region of the first area of the display device; and obtaining the third light-emitting area by subtracting the area of the non-light-emitting region of the first area from the display area of the first area.

Figure 2:
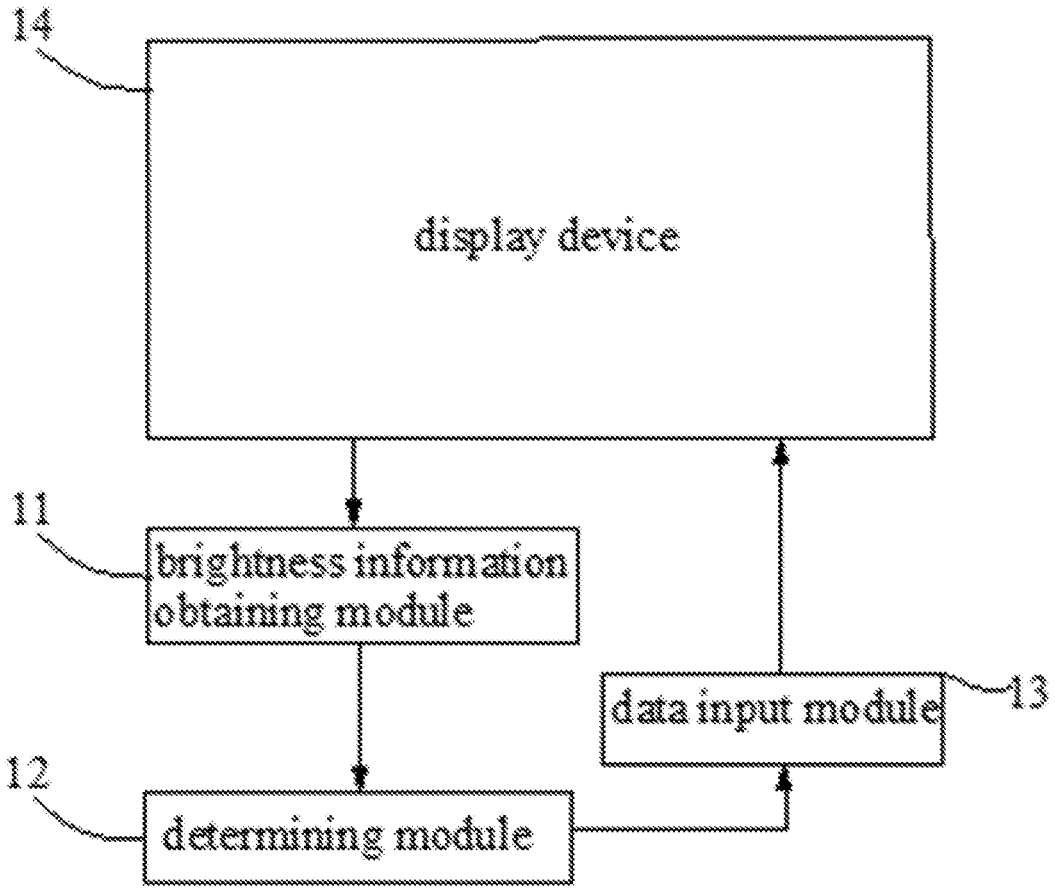
FIG. 2 is a flow diagram illustrating a brightness adjusting device for a display device according to an embodiment of the present disclosure.

As shown in FIG. 2, an embodiment of the present disclosure provides a brightness adjusting device for a display device. The brightness adjusting device for the display device comprises a brightness information obtaining module 11 configured to obtain brightness information of an image to be displayed by a display device 14; a determining module 12 configured to determine whether a peak brightness condition is met according to the brightness information of the image to be displayed by the display device 14, and a data input module 13 configured to apply first voltage data to the display device 14 when the peak brightness condition is met, or apply second voltage data to the display device 14 when the peak brightness condition is not met, wherein the first voltage data is greater than the second voltage data.

The embodiment of the present disclosure provides the brightness adjusting device for the display device. The brightness adjusting device for the display device comprises the brightness information obtaining module, the determining module, and the data input module, wherein the brightness information obtaining module is configured to obtain brightness information of an image to be displayed by a display device, the determining module is configured to determine whether a peak brightness condition is met according to the brightness information of the image to be displayed by the display device, and the data input module is configured to apply first voltage data to the display device when the peak brightness condition is met, or apply second voltage data to the display device when the peak brightness condition is not met, wherein the first voltage data is greater than the second voltage data. Thus when meeting the peak brightness condition, the display device is applied with the second voltage data greater than the first voltage data, increasing brightness when the display device emits light and even increasing the brightness to the peak brightness, improving the contrast, and solving the technical problem that the brightness of the current mini LED screen cannot reach the peak to cause the poor contrast of the screen.

In an embodiment, the brightness information obtaining module comprises a first brightness information obtaining module configured to obtain a first light-emitting area of the display device, a second brightness information obtaining module configured to obtain a second light-emitting area of the image to be displayed by the display device, and a first brightness information processing module configured to obtain the brightness information of the image to be displayed by the display device according to the first light-emitting area and the second light-emitting area.

In an embodiment, the first brightness information obtaining module comprises a first area obtaining module configured to obtain an area of a display area of the display device, a second area obtaining module configured to obtain an area of a non-light-emitting region of the display area of the display device, and an area processing module configured to obtain the first light-emitting area by subtracting the area of the non-light-emitting region of the display area from the area of the display area.

In an embodiment, the second area obtaining module comprises a pixel information obtaining module configured to determine a number of pixels in the image to be displayed, a pixel area module configured to obtain an area of a single one of the pixels, and a pixel area processing module configured to determine the second light-emitting area according to the number of the pixels in the image to be displayed and the area of the single one of the pixels.

In an embodiment, the first brightness information processing module comprises a first processing module configured to obtain first data by dividing the second light-emitting area by the first light-emitting area, and a second processing module configured to use the first data as the brightness information of the image to be displayed by the display device.

In an embodiment, the determining module comprises a first data obtaining module configured to obtain the first data as the brightness information of the image to be displayed by the display device, a setting module configured to set second data as a judging condition of a brightness stage of the display device, a comparing module configured to compare the first data with the second data, and a comparison processing module configured to determine whether the peak brightness condition is met according to a comparison between the first data and the second data.

In an embodiment, the data input module comprises a second voltage data setting module configured to set the second voltage data, and a first voltage data setting module configured to set the first voltage data according to the second voltage data and preset data.

In an embodiment, the first voltage data setting module comprises a second voltage data obtaining module configured to obtain the second voltage data, a preset data setting module configured to set the preset data according to the first data, and a first voltage data determining module configured to set the first voltage data according to the second voltage data and the preset data.

In an embodiment, the brightness information obtaining module comprises a third brightness information obtaining module configured to obtain a third light-emitting area of a first area of the display device, a fourth brightness information obtaining module configured to obtain a fourth light-emitting area of the image to be displayed by the display device, and a second brightness information processing module configured to obtain the brightness information of the image to be displayed by the display device according to the third light-emitting area and the fourth light-emitting area.

In an embodiment, the third brightness information obtaining module comprises a display area of the first area obtaining module configured to obtain a display area of the first area of the display device, a non-light-emitting region of the first area obtaining module configured to obtain an area of a non-display region of the first area of the display device, and a first area processing module configured to obtain the third light-emitting area by subtracting the area of the non-light-emitting region of the first area from the display area of the first area.

In Table 1, a correspondence between voltage data and brightness in the prior art are shown as below, wherein B2 refers to the brightness in the first grayscale and the voltage data is a data value input in binary. In a current display device, due to a one-to-one correspondence between the voltage data and the brightness, the voltage data changes linearly in different grayscales, without considering the actual brightness required, thereby causing inability of brightness of the display device to reach the peak and making contrast of the display panel poor.

TABLE 1

| Voltage data | Brightness |
|---|---|
| 000001 | B2 |
| 000010 | 2*B2 |
| 000011 | 3*B2 |
| . . . | . . . |
| 111111 | 63*B2 |

In Table 2, a correspondence between voltage data and brightness provided in an embodiment of the present disclosure is shown as below, wherein B1 refers to the brightness in the first grayscale and the voltage data is a data value input in binary. As shown in the table, for the display device of 64 grayscales, there will be voltage data of 64 grayscales that meets the peak condition and voltage data of 64 grayscales that does not meet the peak condition. As shown in Table 2, after the peak condition is met, the voltage data in the first grayscale increases, making the brightness of the display device double, and correspondingly increasing the brightness of the second grayscale to the sixty-third grayscale. Thus, in comparison with the brightness when the peak condition is not met, the brightness when the peak condition is met doubles, making the display device reach the peak brightness and improving the contrast.

TABLE 2

| | Grayscale | Voltage data | Brightness |
|---|---|---|---|
| When the peak condition is not met | 1 | 0000001 | B1 |
| | 2 | 0000010 | 2*B1 |
| | 3 | 00000011 | 3*B1 |
| | . . . | . . . | . . . |
| | 63 | 01111111 | 63*B1 |
| When the peak condition is met | 1 | 0000010 | 2*B1 |
| | 2 | 0000100 | 4*B1 |
| | 3 | 0000110 | 6*B1 |
| | . . . | . . . | . . . |
| | 63 | 11111111 | 127*B1 |

It should be noted that Table 1 and Table 2 do not show the grayscale when the brightness is 0.

It should be noted that table 1 and table 2 only represent brightness contrast between the display devices of 64 grayscales in the prior art and in the embodiment of the present disclosure, but the embodiment of the present disclosure is not limited hereto. For display devices of other grayscales such as 256 grayscales, there is also a corresponding voltage data input, meanwhile, in comparison with the brightness when the peak condition is not met, an increase of the brightness when the peak condition is met is not limited to double, but can be other multiples, such as 3-fold and 1.5-fold, determined by the voltage data that can actually achieve the peak brightness.

In a scene, whether the peak brightness is met can be determined according to the below tables. As shown in Tables 3 and 4, A1 and A2 refer to voltage data there, A1 and A2 represent that it is lightened there, and 00 represent that it is not lightened there. The peak brightness condition is set as that a ratio of an area of a lightened part occupied is equal to or less than 4%. A ratio of an area of a lightened part occupied in Table 3 is equal to 4% and the peak brightness condition is met, and A1 can be changed to A2 for input, wherein A2 is greater than A1, so as to reach the peak brightness and improve the contrast.

TABLE 3

| | | | | |
|---|---|---|---|---|
| 00 | 00 | 00 | 00 | 00 |
| 00 | A1 | 00 | 00 | 00 |
| 00 | 00 | 00 | 00 | 00 |
| 00 | 00 | 00 | 00 | 00 |
| 00 | 00 | 00 | 00 | 00 |

TABLE 4

| | | | | |
|---|---|---|---|---|
| 00 | 00 | 00 | 00 | 00 |
| 00 | A2 | 00 | 00 | 00 |
| 00 | 00 | 00 | 00 | 00 |
| 00 | 00 | 00 | 00 | 00 |
| 00 | 00 | 00 | 00 | 00 |

According to the above embodiments, the method for adjusting brightness of the display device are provided. The method for adjusting brightness of the display device comprises obtaining brightness information of an image to be displayed by a display device, determining whether a peak brightness condition is met according to the brightness information of the image to be displayed by the display device, and applying first voltage data to the display device when the peak brightness condition is met, or applying second voltage data to the display device when the peak brightness condition is not met, wherein the first voltage data is greater than the second voltage data. Before applying the display voltage data to the display device, whether the peak brightness condition is met is determined first, wherein the first voltage data is applied to the display device when the peak brightness condition is met, or the second voltage data is applied to the display device when the peak brightness condition is not met, enabling the first voltage data greater than the second voltage data to be applied to the display device when the peak brightness condition is met, increasing brightness when the display device emits light to display the image to be displayed and even increasing the brightness to peak brightness, improving the contrast, and solving the technical problem that the brightness of the current mini LED screen cannot reach the peak to cause the poor contrast of the screen.

It can be understood that, for those skilled in the art, equivalent replacements and modifications can be made according to the technical solution and invention ideas thereof of the present disclosure, and all these modifications or replacements are considered within the protection scope of the attached claims of the present disclosure.

What is claimed is:

1. A method for adjusting brightness of a display device, comprising following steps:

obtaining brightness information of an image to be displayed by the display device;

determining whether a peak brightness condition is met according to the brightness information of the image to be displayed by the display device; and applying a first voltage data to the display device when the peak brightness condition is met, or applying a second voltage data to the display device when the peak brightness condition is not met, wherein the first voltage data is greater than the second voltage data;

wherein the step of obtaining the brightness information of the image to be displayed by the display device comprises:

obtaining a first light-emitting area of the display device;

obtaining a second light-emitting area of the image to be displayed by the display device;

obtaining a first data by dividing the second light-emitting area by the first light-emitting area; and using the first data as the brightness information of the image to be displayed by the display device; wherein the brightness information of the image to be displayed by the display device is a ratio of the second light-emitting area to the first light-emitting area.

2. The method for adjusting brightness of the display device as claimed in claim 1, wherein the step of obtaining the first light-emitting area of the display device comprises:

obtaining an area of a display area of the display device;

obtaining an area of a non-light-emitting region of the display area of the display device; and obtaining the first light-emitting area by subtracting the area of the non-light-emitting region of the display area from the area of the display area.

3. The method for adjusting brightness of the display device as claimed in claim 2, wherein the step of obtaining the second light-emitting area of the image to be displayed by the display device comprises:

determining a number of pixels in the image to be displayed;

obtaining an area of a single one of the pixels; and determining the second light-emitting area according to the number of the pixels in the image to be displayed and the area of the single one of the pixels.

4. The method for adjusting brightness of the display device as claimed in claim 1, wherein the step of determining whether the peak brightness condition is met according to the brightness information of the image to be displayed by the display device comprises:

obtaining the first data as the brightness information of the image to be displayed by the display device;

setting a second data as a judging condition of a brightness stage of the display device;

comparing the first data with the second data; and determining whether the peak brightness condition is met according to a comparison between the first data and the second data.

5. The method for adjusting brightness of the display device as claimed in claim 4, wherein the step of applying the first voltage data to the display device when the peak brightness condition is met, or applying the second voltage data to the display device when the peak brightness condition is not met, wherein the first voltage data is greater than the second voltage data, comprises:

setting the second voltage data; and setting the first voltage data according to the second voltage data and a preset data.

6. The method for adjusting brightness of the display device as claimed in claim 5, wherein the step of setting the first voltage data according to the second voltage data and the preset data comprises:

obtaining the second voltage data;

setting the preset data according to the first data; and setting the first voltage data according to the second voltage data and the preset data.

7. The method for adjusting brightness of the display device as claimed in claim 1, wherein the step of obtaining brightness information of the image to be displayed by the display device comprises:

obtaining a third-light emitting area of a first area of the display device;

obtaining a fourth-light emitting area of the image to be displayed by the display device; and obtaining the brightness information of the image to be displayed by the display device according to the third light-emitting area and the fourth light-emitting area.

8. The method for adjusting brightness of the display device as claimed in claim 7, wherein the step of obtaining the third light-emitting area of the first area of the display device comprises:

obtaining a display area of the first area of the display device;

obtaining an area of a non-light-emitting region of the first area of the display device; and obtaining the third light-emitting area by subtracting the area of the non-light-emitting region of the first area from the display area of the first area.

9. A display device, comprising:

a processor;

a memory; and instructions stored in the memory and configured to be executed by the processor to perform a method, the method comprising following steps:

obtaining brightness information of an image to be displayed by the display device;

determining whether a peak brightness condition is met according to the brightness information of the image to be displayed by the display device; and applying a first voltage data to the display device when the peak brightness condition is met, or applying a second voltage data to the display device when the peak brightness condition is not met, wherein the first voltage data is greater than the second voltage data;

wherein the step of obtaining the brightness information of the image to be displayed by the display device comprises:

obtaining a first light-emitting area of the display device;

obtaining a second light-emitting area of the image to be displayed by the display device;

obtaining a first data by dividing the second light-emitting area by the first light-emitting area; and using the first data as the brightness information of the image to be displayed by the display device; wherein the brightness information of the image to be displayed by the display device is a ratio of the second light-emitting area to the first light-emitting area.

10. The display device as claimed in claim 9, wherein the step of obtaining the first light-emitting area of the display device comprises:

obtaining an area of a display area of the display device;

obtaining an area of a non-light-emitting region of the display area of the display device; and obtaining the first light-emitting area by subtracting the area of the non-light-emitting region of the display area from the area of the display area.

11. The display device as claimed in claim 10, wherein the step of obtaining the second light-emitting area of the image to be displayed by the display device comprises:

determining a number of pixels in the image to be displayed;

obtaining an area of a single one of the pixels; and determining the second light-emitting area according to the number of the pixels in the image to be displayed and the area of the single one of the pixels.

12. The display device as claimed in claim 9, wherein the step of determining whether the peak brightness condition is met according to the brightness information of the image to be displayed by the display device comprises:

obtaining the first data as the brightness information of the image to be displayed by the display device;

setting a second data as a judging condition of a brightness stage of the display device;

comparing the first data with the second data; and determining whether the peak brightness condition is met according to a comparison between the first data and the second data.

13. The display device as claimed in claim 12, wherein the step of applying the first voltage data to the display device when the peak brightness condition is met, or applying the second voltage data to the display device when the peak brightness condition is not met, wherein the first voltage data is greater than the second voltage data, comprises:

setting the second voltage data; and setting the first voltage data according to the second voltage data and a preset data.

14. The display device as claimed in claim 13, wherein the step of setting the first voltage data according to the second voltage data and the preset data comprises:

obtaining the second voltage data;

setting the preset data according to the first data; and setting the first voltage data according to the second voltage data and the preset data.

15. The display device as claimed in claim 9, wherein the step of obtaining brightness information of the image to be displayed by the display device comprises:

obtaining a third light-emitting area of a first area of the display device;

obtaining a fourth light-emitting area of the image to be displayed by the display device; and obtaining the brightness information of the image to be displayed by the display device according to the third light-emitting area and the fourth light-emitting area.

16. The display device as claimed in claim 15, wherein the step of obtaining the third light-emitting area of the first area of the display device comprises:

obtaining a display area of the first area of the display device;

obtaining an area of a non-display region of the first area of the display device; and obtaining the third light-emitting area by subtracting the area of the non-light-emitting region of the first area from the display area of the first area.

* * * * *